US005992655A

United States Patent [19]

Greenberg et al.

[11] Patent Number: 5,992,655

[45] Date of Patent: Nov. 30, 1999

[54] CATERPILLAR SIDEBOOM REPLACEMENT ASSEMBLY

[76] Inventors: Alan S. Greenberg, 2811A Ferndale, Houston, Tex. 77098; Giordano Grassi, Via Roma, San Pancrazio, Italy

[21] Appl. No.: 09/317,532

[22] Filed: May 24, 1999

Related U.S. Application Data

[63] Continuation-in-part of application No. 08/925,501, Sep. 8, 1997, abandoned.

[51] Int. Cl.[6] ..... B66C 23/46

[52] U.S. Cl. ..... 212/258; 212/278; 212/281

[58] Field of Search ..... 212/279, 289, 212/281, 285, 258, 278; 414/745.6

[56] References Cited

U.S. PATENT DOCUMENTS

| | | | |
|---|---|---|---|
| 2,909,290 | 10/1959 | Nichols | 212/195 |
| 3,722,707 | 3/1973 | Hedeen et al. | 212/281 |
| 3,785,503 | 1/1974 | Butterfield et al. | 212/289 |
| 4,170,308 | 10/1979 | Rogers | 212/281 |
| 4,566,599 | 1/1986 | Villa et al. | 212/285 |
| 5,332,110 | 7/1994 | Forsyth | 212/258 |

FOREIGN PATENT DOCUMENTS

| | | | |
|---|---|---|---|
| 1521698 | 11/1989 | U.S.S.R. | 212/196 |
| 1202528 | 8/1970 | United Kingdom | 212/289 |

*Primary Examiner*—Thomas J. Brahan

*Attorney, Agent, or Firm*—Harrison & Egbert

[57] ABSTRACT

A replacement assembly is provided for retrofitting old, discontinued, mechanically-operated, low-drive, Caterpillar sidebooms with a hydraulically-operated fail-safe sideboom system. Conversion of discontinued, mechanically-operated, low-drive, Caterpillar sidebooms is accomplished by replacing the entire existing mechanical assembly with a single frame-mounted hydraulic assembly comprising a boom winch, a load winch, and preferably a single hand-operated joystick control. This single frame assembly is configured to be received by the existing foundation on discontinued Caterpillar sidebooms. Joystick technology is provided which negates cumbersome clutches and related multiple controls by affording a sideboom operator the ability to completely control the functions of both the boom and the load with a single joystick control which replaces the six conventional hand-operated mechanical controls that exist on the discontinued Caterpillar sidebooms. An anti-tipping feature assures efficient, safe operation and tends to maximize the longevity of old, discontinued, mechanically-operated, low-drive, Caterpillar sidebooms by meeting modem safety standards for lifting devices. An anti-two-block feature is provided that prevents contact damage by stopping the upward travel of the hook block if it is about to come in contact with the sideboom's stationary upper block. A free-fall feature is also provided so that an operator may instantly release the brakes on the load winch, causing the load to free fall.

13 Claims, 15 Drawing Sheets

Prior Art

CATERPILLAR SIDEBOOM REPLACEMENT ASSEMBLY

RELATED APPLICATIONS

This application is a continuation-in-part of U.S. application Ser. No. 08/925,501 filed Sep. 8, 1997, now abandoned.

BACKGROUND OF THE INVENTION

The present invention relates to Caterpillar sidebooms used for pipelaying, and more particularly pertains to methods and apparatus for converting old, discontinued, mechanically-operated, low-drive, Caterpillar sidebooms into hydraulically-operated sidebooms, with minimal retrofitting.

It is well known in the art that crawler or tractor-type vehicles having an integrated, rigid maneuverable boom disposed on a side thereof are commonly used for pipelaying operations, i.e., for raising, carrying, and lowering heavy pipe. Referred to as "sidebooms," such vehicles must be capable of safely handling heavy pipe; indeed, there are sideboom models that have been constructed for handling pipe up to 200,000 pounds. Such sidebooms were mechanically-operated in their first incarnation and are now readily available from original equipment manufacturers in hydraulically-operated models.

An early development in the mechanical sideboom art is disclosed by Butterfield et al. in U.S. Pat. No. 3,785,503, wherein a plurality of planetary gears and concomitant shafts are used to drive the winch drums for each of the boom and the load. Primarily due to its inherent complicated, high-maintenance gearing system, no embodiments of the Butterfield sideboom was ever commercialized. A significant improvement in the pipelaying sideboom art would be a sideboom that eliminates all gears to accomplish transmission of power, i.e., that eliminates all mechanical connections between the engine and the winch system.

Other early developments in the sideboom art, albeit not applicable to pipelaying operations, per se, are taught in U.S. Pat. Nos. 2,909,290; and 3,329,283. More particularly, Nichols, in U.S. Pat. No. 2,909,290, teaches a farm tractor-mounted sideboom intended for lifting light loads typical on the farm. Of course, pipelaying operations demand sidebooms with lifting capacities up to 200,000 pounds. Similarly, Wade, in U.S. Pat. No. 3,329,283, teaches a snap mount sideboom configured to be foldable for reducing its prerequisite overhead clearance. Half of the Wade boom's height may be reduced and the folded boom portion secured to the tractor's side by using integral hooks and cable. Especially in view of the Wade sideboom having no counterweight, it should be evident to those skilled in the art that both Wade and Nichols are inapplicable to the rigors of pipelaying wherein not only a strong, firm boom structure is required, but also the framework of the sideboom must be sufficiently broad to provide a low enough center of gravity for stability and must include a counterweight to provide sufficient operational stability and safety. It will be readily understood by those skilled in the art that such attributes are not provided by conventional tractors.

Indicative of initial attempts to improve the sideboom art using hydraulics is an apparatus described by Stefanutti in U.S. Pat. No. 3,265,218. In particular, the use of hydraulically actuated booms and hoist assemblies is described, wherein hydraulic cylinders are used either inside or astride the boom to raise and lower the boom. As will be appreciated by those skilled in the art, the Stefanutti apparatus has not been widely accepted.

As taught by Vinton in U.S. Pat. No. 3,938,669, however, while the introduction of such hydraulically-operated sidebooms were anticipated to provide improvements associated with effectively and safely manipulating winches and cables through an operator's interfacing with clutches, brakes, and levers for controlling the position of the boom and for hoisting and lowering a load, such sidebooms failed to provide the prerequisite control and versatility. To attempt to remedy this deficiency in the art, Vinton discloses a hydraulic circuit that includes two separate sources of hydraulic fluid for controlling sideboom movement-related functions. One fluid source provides low volume hydraulic fluid for accomplishing not only precise, low-speed manipulation and control, but also for preventing anti-drift of both boom and hoist. The other fluid source provides high volume hydraulic fluid for providing high-speed operation of these movement and control functions. The plurality of control valves inherent in the Vinton circuit for controlling the hoist and the boom motors are operated via two levers. This apparatus also incorporates a hydraulic cylinder, instead of a drum/cable arrangement for controlling the boom; no drums or cables are involved in raising or lowering either the boom or the hook, except a short cable connected to the hook at the end of a hydraulic cylinder. As is well known by those skilled in the sideboom art, this methodology was a commercial failure.

As a further development in the sideboom art, Forsyth teaches in U.S. Pat. No. 5,332,110 a hydraulically-operated sideboom intended to prevent boom over-rotation, to impart positive drive to the boom and load winches, and to provide improved control over free fall and vertical kick-out. These safe operating features are particularly intended for pipelaying applications involving lifting and lowering of large pipes. Indicative of current Caterpillar tractors and sidebooms, embodiments taught by Forsyth are exclusively for newly manufactured hydraulically-operated high-drive tractors which are the antithesis of predecessor low-drive mechanically-operated Caterpillar tractors.

As will be appreciated by those skilled in the sideboom art, current Caterpillar hydraulically-operated high-drive sidebooms have a higher center of gravity but operate easier due to less controls than old, discontinued, mechanically-operated, low-drive, Caterpillar sidebooms. Such "high drive" models are constructed with an undercarriage that was introduced by Caterpillar in the early 1980's; the sprockets and drive mechanisms for the undercarriage are situated much higher off the ground than the previous conventional "low drive" system that was in effect from the inception of the original Caterpillar sideboom. More particularly, the Caterpillar low-drive sidebooms were discontinued from 1972 through 1986 as follows: model 572E was discontinued in 1972; model 572F was discontinued in 1975; model 572G was discontinued in 1986; model 583H was discontinued in 1974; model 583K was discontinued in 1986; model 594G was discontinued in 1975; and model 594H was discontinued in 1986. In addition, Caterpillar hydraulically-operated high-drive sidebooms are very expensive, and some models not only have inherent counterweight obstruction problems, but also are difficult to move from job-site to job-site. While the Forsyth disclosure teaches that his hydraulic pipelayer is adapted for mounting upon a conventional track-laying tractor (i.e., bulldozer), it is well known in the art that the main frame of a sideboom is constructed differently from that of a conventional tractor. In particular, unlike a conventional tractor which is constructed with an oscillating frame, a sideboom is constructed with a rigid frame of wider track gauge than a conventional tractor. Indeed, Caterpillar identifies such tractor and sideboom frames with different serial numbers series. Thus, to obtain the prerequisite performance demanded in the pipelaying art, a drawworks assembly must be mounted upon a frame capable of rigidity to accommodate the pivoting action of a sideboom typically positioned upon rough terrain, with the frame having a sufficiently wide track gauge for stability purposes.

As will be understood by practitioners in the art, a drawworks system built upon an old, discontinued, mechanically-operated, low-drive, Caterpillar sideboom—having significantly more controls than a conventional discontinued tractor—inherently suffers from a panoply of problems associated with the simultaneous use of a daunting ensemble of gear-shifting mechanisms, clutches, and brakes, all operated by 6 different hand controls to properly lift and manipulate heavy pipes under conditions generally characterized by unpredictable and adverse terrain. Pipeline construction companies constitute 95% of the users of this type of machinery. As will be appreciated by those conversant with the art, historically, such pipeline construction companies have had to choose between the newer high-drive sidebooms with herein before mentioned faults and high price or the older, discontinued Caterpillar sidebooms that are more economical but are more dangerous and are very difficult to operate. It should also be noted that, as the pipelaying industry continues to mature, the number of skilled sideboom operators has gradually diminished.

As should be evident to those skilled in the art, it would be advantageous for construction companies who are continuing to utilize older discontinued Caterpillar sidebooms to have the additional benefits of improved handling, safety, and efficiency. It would be also be advantageous for pipeline contractors to have the ability to expeditiously train low-drive Caterpillar sideboom operators and to simultaneously achieve a level of safety heretofore unmatched by any other sideboom system known in the art, regardless of design. Of course, it would be advantageous for pipelaying contractors to have the benefit of a Caterpillar sideboom that inherently avoids or mitigates the complex levers and the like associated with maneuvering a sideboom, and controlling the lifting and lowering of a pipe load.

Accordingly, these limitations and disadvantages of the prior art are overcome with the present invention, and improved means and techniques are provided which are useful for effectively and reliably utilizing old, discontinued, mechanically-operated, low-drive, Caterpillar sidebooms for pipelaying applications.

SUMMARY OF THE INVENTION

In accordance with the present invention, an assembly is provided for retrofitting old, discontinued, mechanically-operated, low-drive, Caterpillar sidebooms with a hydraulically-operated fail-safe sideboom system. Specifically, the present invention provides a replacement assembly that is plug-to-plug compatible only with Caterpillar sideboom models 572E, 572F, 572G, 583H, 583K, 594G, and 594H, all of which have been discontinued for a minimum of 11 years. The construction and operation of such sidebooms is well known in the art as is illustrated in publication AECW9083 entitled "Caterpillar-built Pipelayers." As will become apparent to those skilled in the art, the present invention teaches a method for converting older, discontinued, low-drive, mechanically-operated Caterpillar sidebooms into efficient and safe lifting and lowering machines.

As will be hereinafter described in detail, the present invention accomplishes this conversion of old, discontinued, mechanically-operated, low-drive, Caterpillar sidebooms by replacing the entire existing mechanical assembly with a single frame-mounted hydraulic assembly including a boom winch, a load winch, a hydraulic motor for each winch, a hydraulic pump, a hydraulic fluid tank and related hydraulic hoses, and ancillary components, and preferably a single joystick control means.

As will be appreciated by those skilled in the art, this single frame assembly is configured to be conveniently received by the foundation existing on old, discontinued, mechanically-operated, low-drive, Caterpillar sidebooms, including matching the plurality of bolt holes contained therein.

The present invention, in addition to modernizing a substantial inventory of Caterpillar sidebooms, provides joystick technology to old, discontinued, mechanically-operated, low-drive, Caterpillar sidebooms, wherein a long-established, routinely-accepted combination of cumbersome clutches and related multiple controls is replaced by a single joystick control. As will be appreciated by those skilled in the art, the present invention affords a sideboom operator the ability to completely control the functions of both the boom and the load with a single joystick control, which replaces the 6 conventional hand-operated mechanical controls that exist on the discontinued Caterpillar sidebooms.

As will also be understood by those skilled in the art, the present invention also enables old, discontinued low-drive mechanically-operated Caterpillar sidebooms to be inherently insulated from the occurrence of unsafe conditions attributable to exceeding machine capacities caused by a combination of boom angle, load weight and position, and counterweight position. Thus, the anti-tipping feature taught by the present invention assures efficient, safe operation and tends to maximize the longevity of old, discontinued, mechanically-operated, low-drive, Caterpillar sidebooms by meeting modem safety standards for lifting devices.

It is another advantage of the present invention that an anti-two-block feature is provided that stops the upward travel of the hook block if it is about to come in contact with the sideboom's stationary upper block, and thus preventing consequent damage that would result if contact took place. Such damage could include breaking the load line, resulting in the hook block and its load coming free of the load line. In that case, the load would instantly fall to the ground. This anti-two-block feature performs without any wires or connections between the tractor and the boom, or between the tractor and the blocks, or between the tractor and both the boom and the blocks.

However, as will be appreciated by those skilled in the art, one feature of old, discontinued, mechanically-operated, low-drive, Caterpillar sidebooms that needs to be retained is the ability of the operator to "free-fall" the load at his discretion; to instantly release the brakes on the load winch, which causes the load to free fall. This becomes necessary when several sidebooms have simultaneous positions on a long string of pipe, and one or more of them become unbalanced, thus requiring the operators of the other sidebooms to immediately release their hold on the pipe string in order to prevent their sidebooms from being overturned. The present invention provides for this free fall capability.

As will be appreciated by those skilled in the art, another feature of old, discontinued, mechanically-operated, low-drive, Caterpillar sidebooms contemplated by the present invention that needs to be retained is the ability to shut off power to the boom cable if the boom reaches the vertical position. An advantage of the present invention is that a sideboom modernized as taught by the present invention now functions via a positive electronic sensor switch, whereas using electricity to accomplish this action is not possible with the old, discontinued, mechanically-operated, low-drive, Caterpillar sidebooms.

It is an object of the present invention to enable old, discontinued, mechanically-operated, low-drive, Caterpillar sidebooms to be converted into modern, hydraulically-operated sidebooms by providing a "drop in" plug-to-plug compatible assembly that does not require significant retrofitting.

It is another object of the present invention to provide an apparatus and method for replacing the mechanically-operated components of old, discontinued, mechanically-operated, low-drive, Caterpillar sidebooms with a plug-to-plug compatible assembly having hydraulically-operated components.

It is still another object of the present invention to convert old, discontinued, mechanically-operated, low-drive, Caterpillar sidebooms into hydraulically-operated sidebooms suitable for pipelaying applications.

It is still another object of the present invention to convert old, discontinued, mechanically-operated, low-drive, Caterpillar sidebooms into hydraulically-operated sidebooms that operate according to modern safety standards.

It is yet another object of the present invention to convert old, discontinued, mechanically-operated, low-drive, Caterpillar sidebooms into hydraulically- operated sidebooms which may be routinely and safely operated by personnel who otherwise would normally require substantial training.

It is yet another object of the present invention to provide a hydraulically-operated replacement assembly for old, discontinued, mechanically-operated, low-drive, Caterpillar sidebooms, wherein all boom and load movements are controlled by a single lever control means.

It is another object of the present invention to convert old, discontinued, mechanically-operated, low-drive, Caterpillar sidebooms into a hydraulically-operated sideboom that has a single lever control means which can cause both the boom and the load winches to be actuated under power in both directions simultaneously.

It is another object of the present invention to provide a hydraulically-operated replacement assembly for old, discontinued, mechanically-operated, low-drive, Caterpillar sidebooms, wherein all boom and load movements are controlled by a single lever control means which, for safety purposes, will not be active unless the operator positions his thumb on the release button atop the lever.

It is an object of the present invention to provide a replacement sideboom assembly for converting old, discontinued, mechanically-operated, low-drive, Caterpillar sidebooms into hydraulically-operated sidebooms having an electronic computerized anti-tipping feature.

It is another object of the present invention to provide a replacement sideboom assembly for converting old, discontinued, mechanically-operated, low-drive, Caterpillar sidebooms into hydraulically-operated sidebooms having an anti-contacting or anti-two-blocking feature.

It is yet another object of the present invention to provide a replacement sideboom assembly for converting old, discontinued, mechanically-operated, low-drive, Caterpillar sidebooms into hydraulically-operated sidebooms having an electric switch to free-fall the load line.

It is still another object of the present invention to provide a replacement sideboom assembly for converting old, discontinued, mechanically-operated, low-drive, Caterpillar sidebooms into hydraulically-operated sidebooms having an electronic vertical boom kick-out safety feature.

These and other objects and features of the present invention will become apparent from the following detailed description, wherein reference is made to the figures in the accompanying drawings in which like numerals refer to like components.

IN THE DRAWINGS

Figure 11A:
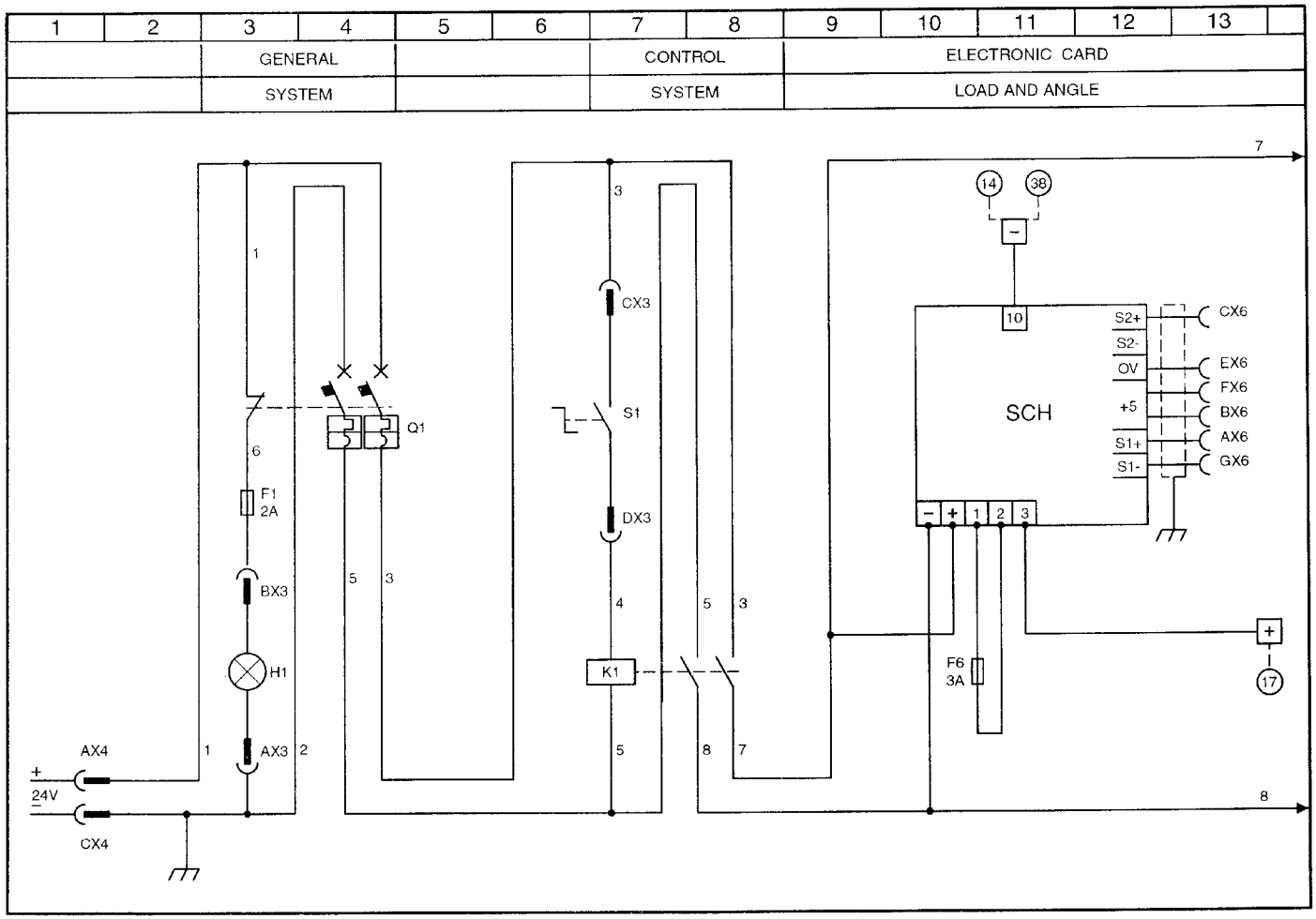
Figure 11B:
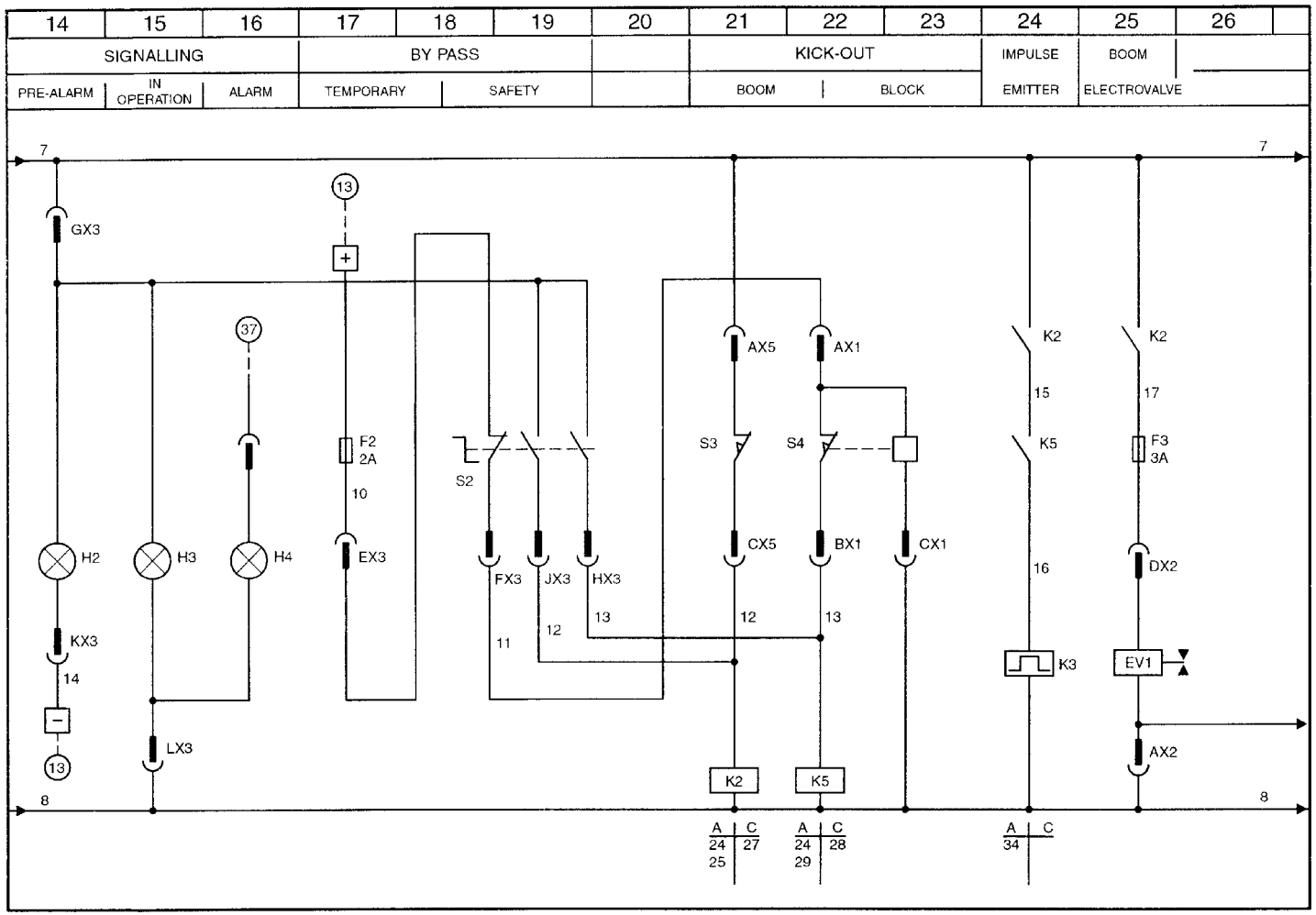
Figure 11C:
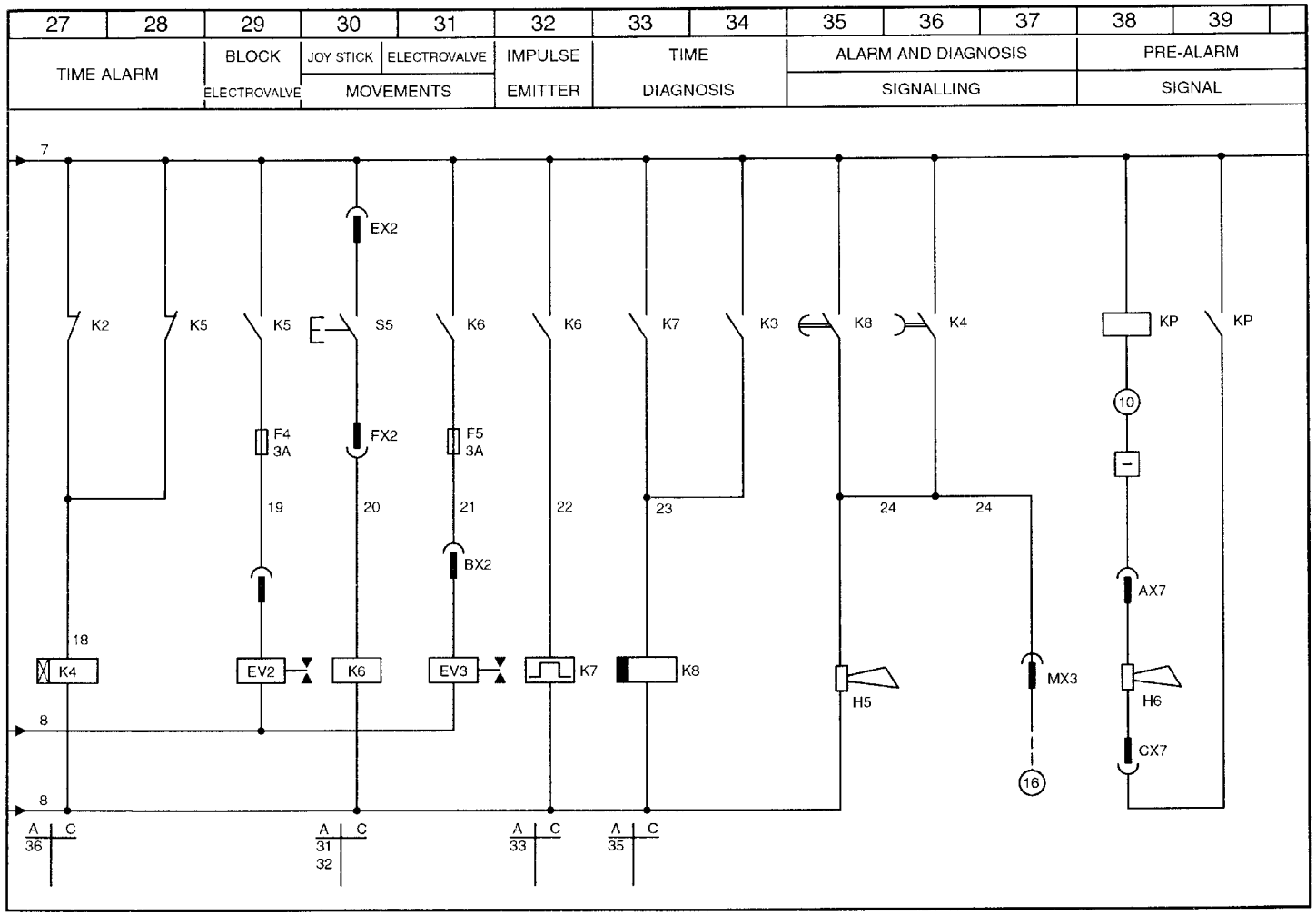

FIGS. 11A–C depict a schematic of the internal circuitry of the anti-tipping apparatus embodying the present invention.

Figure 12:
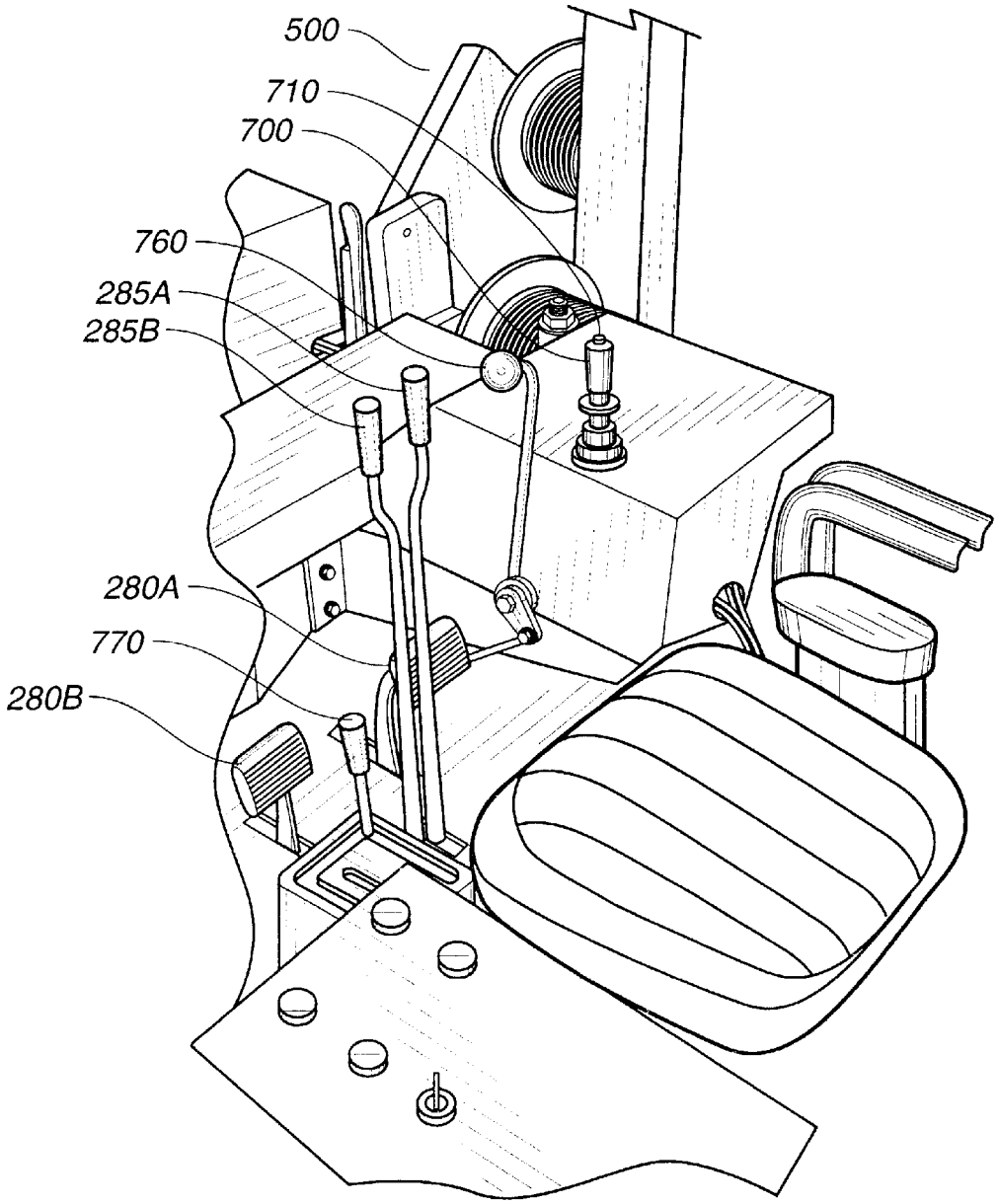

FIG. 12 depicts a perspective top view of the controls available to the operator after the retrofitting of the present invention. Included is the single lever control apparatus.

Figure 13:
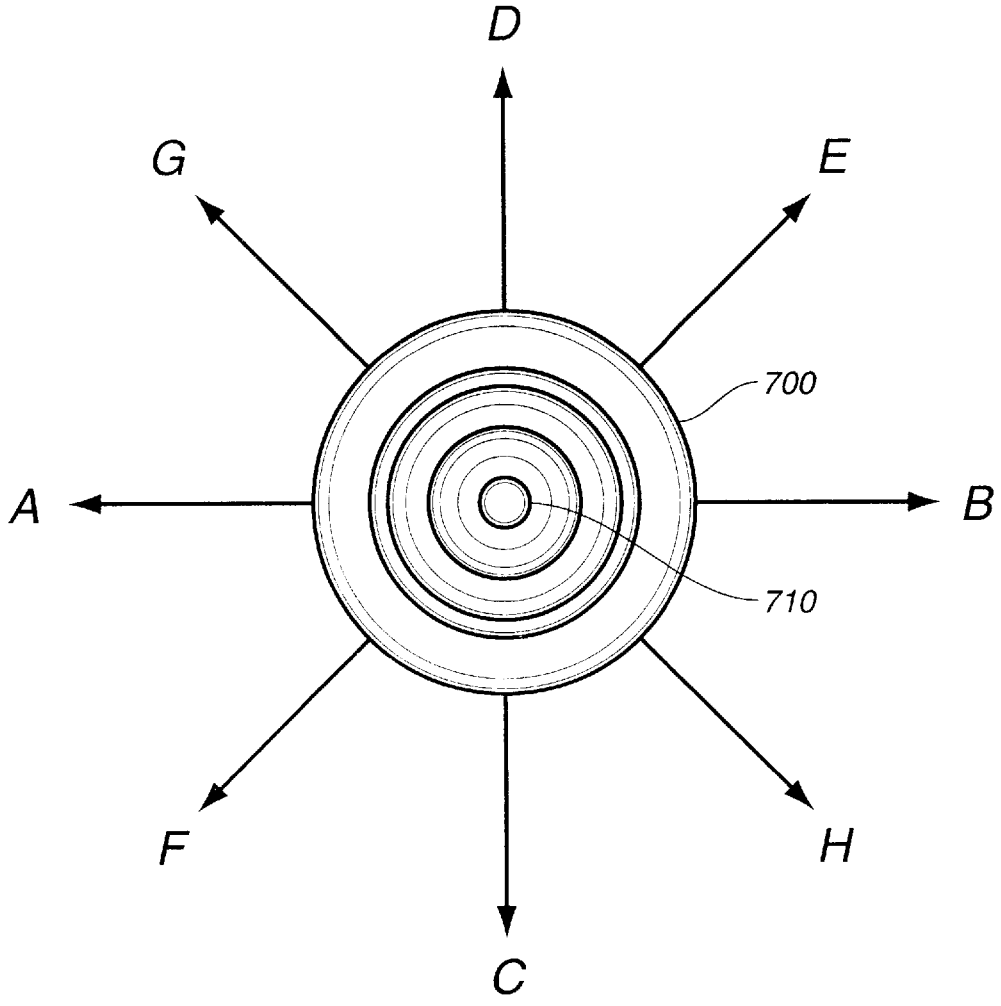

FIGS. 13 depicts a simplified top planar view depicting the eight control positions of the single lever control apparatus depicted in FIG. 12.

DETAILED DESCRIPTION

Figure 1A:
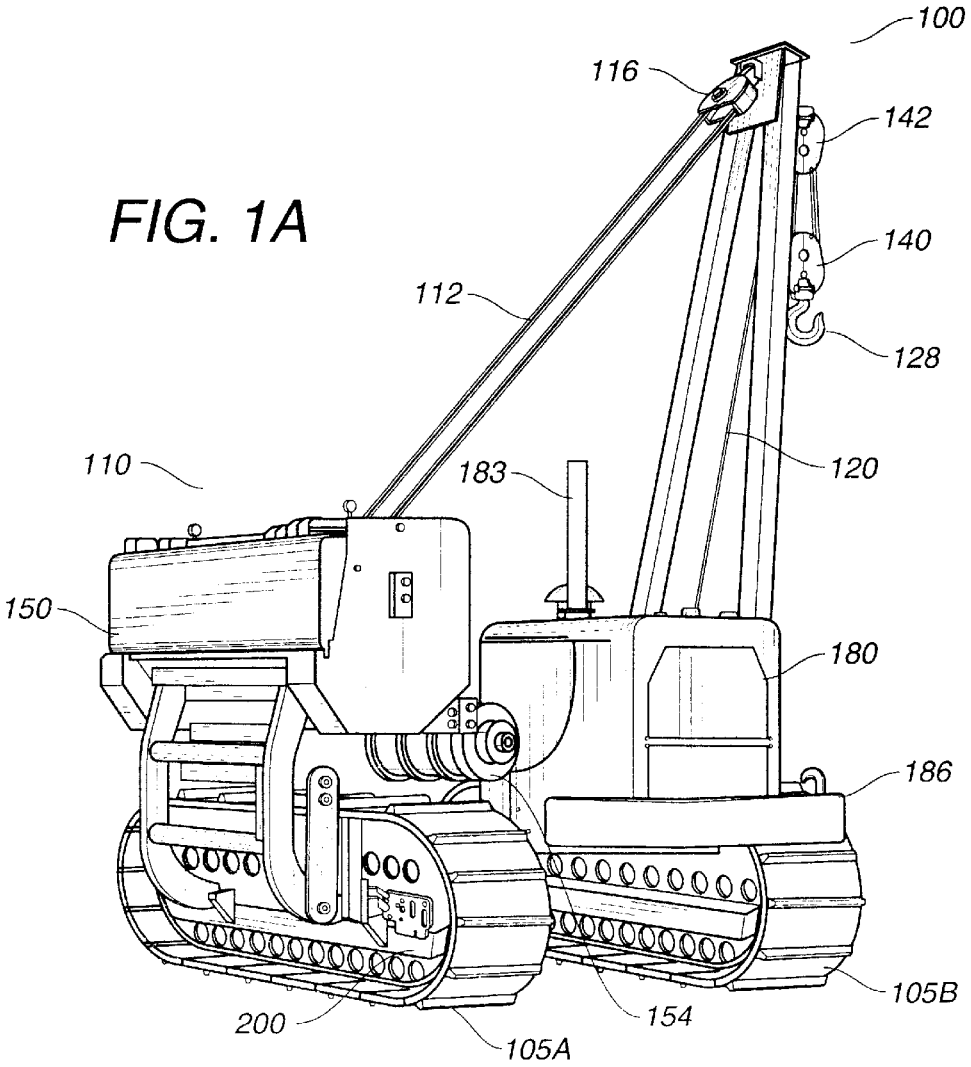
FIG. 1A Prior Art
FIG. 1A depicts a frontal perspective view of an old, discontinued, mechanically-operated, low-drive, Caterpillar sideboom.
Figure 1B:
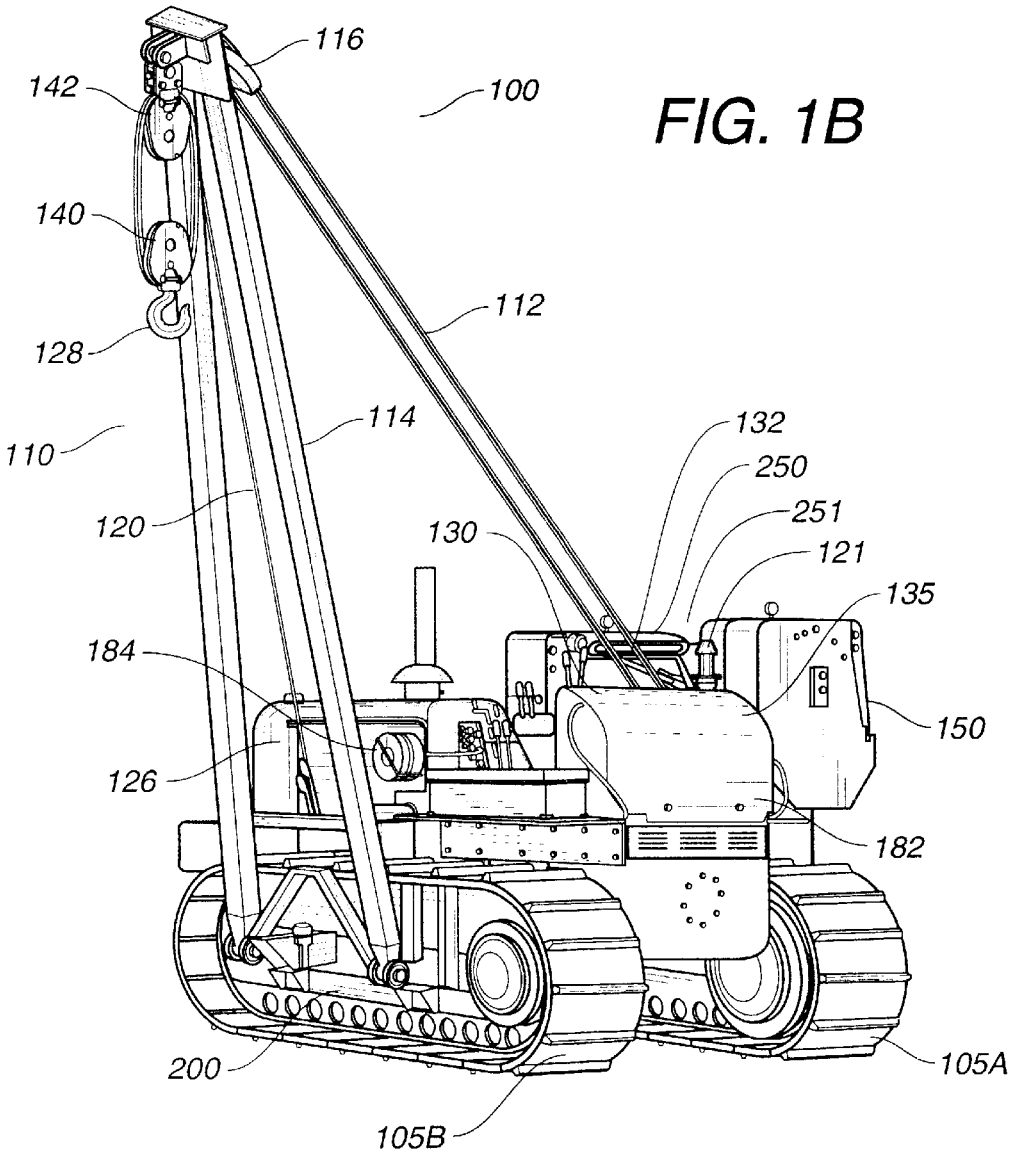
FIG. 1B Prior Art
FIG. 1B depicts a rear perspective view of the sideboom depicted in FIG. 1A.

Referring now to FIGS. 1A and 1B, there are illustrated front and rear perspective views, respectively, of an old, discontinued, mechanically-operated, low-drive, Caterpillar sideboom, well known in the pipelayer art. Generally shown for such a conventional sideboom 100 are pair of endless tracks 105 A and B, drawworks 110, boom 114, counterweight assembly 150, diesel engine 180, muffler means 183, bumper 186, and framework means 200. Drawworks 110 includes boom winch 130, load winch 135, drawworks transmission 121, and plurality of hand-controls 251. Boom winch 130 has boom line 112 which is wound around it. Boom winch 130 is coupled to upper boom block 116 via boom line 112. In a manner well known in the art, boom line 112 extends from boom winch 130 around upper boom block 116 and then around lower boom block 132 back to upper boom block 116 to which boom line 112 is connected. Load winch 135 has load line 120 which extends around load line sheave 126 and then around load block 142 to hook block 140, which has hook 128 extending therefrom. Hook block 140 and load block 142 constitute a block pair suspended from load line 120. It will be readily understood that rotation of load winch 135 in one direction raises hook block 140, while rotation of load winch 135 in the opposite direction lowers hook block 140. Also shown are fuel tank 182, air cleaner 184, and battery compartment 188.

Figure 2:
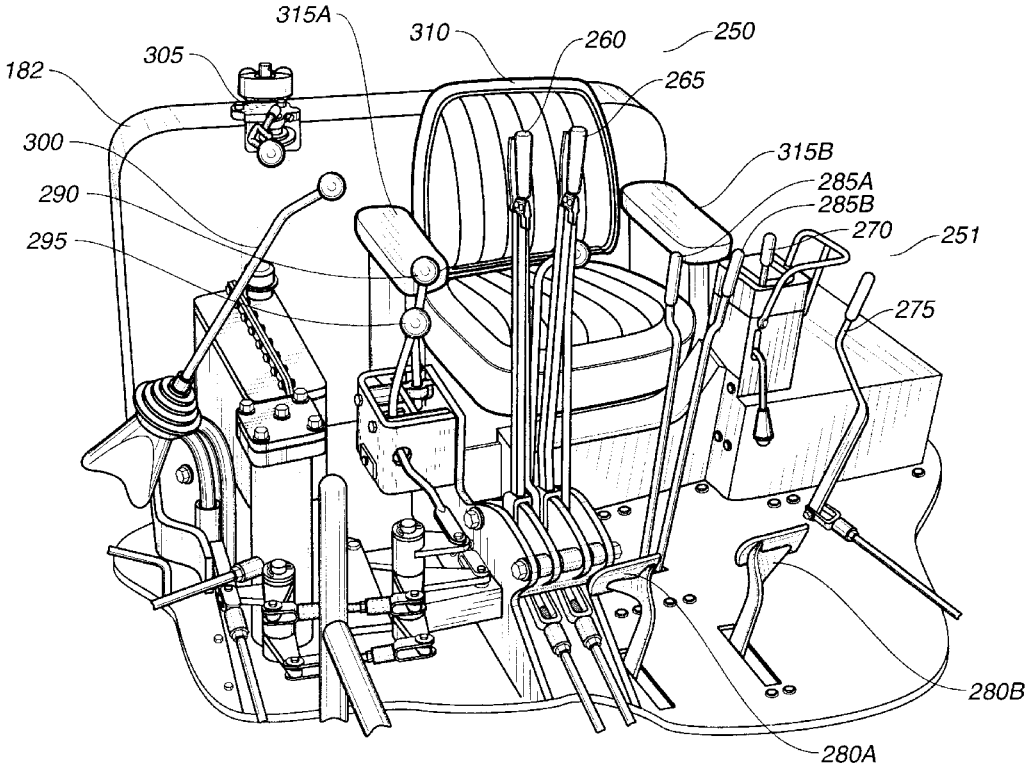
FIG. 2 depicts a frontal perspective view of the plurality of levers and controls associated with the Caterpillar sideboom depicted in FIGS. 1A and 1B.

Referring now to FIG. 2 there is shown a frontal perspective view of the operator's compartment 250 of a conventional sideboom depicted in FIGS. 1A and 1B. The complexity of winch and transmission controls required to operate an old, discontinued, mechanically-operated, low-drive, Caterpillar sideboom is clear, of course, to those skilled in the art. Separate hand-operated clutch controls 290 and 295 engage and disengage their corresponding boom and load winches 130 and 135. Also shown are corresponding hand-operated boom winch and load winch brake controls 260 and 265, which have conventional locking grip handles affixed thereto. A hand-operated drawworks transmission gear shift control 300 provides three-speeds for forward movement and one speed for reverse. Also shown is hand-operated drawworks master clutch lever 275 and hand-operated counterweight control 305. Completing the operator's controls are each of hydraulically actuated multiple disc oil steering clutches 285A and 285B, and hydraulically boosted oil-cooled contracting band brakes 280A and 280B. As is well known in the art, each of boom line brake lever 260, load line brake lever 265, boom line clutch lever 290, and load line clutch lever 295 are console-mounted directly in front of the operator's right arm rest 315A of seat 310. Hydraulic counterweight control lever 305 is mounted beside seat 310 disposed upon fuel tank 182.

Figure 3A:
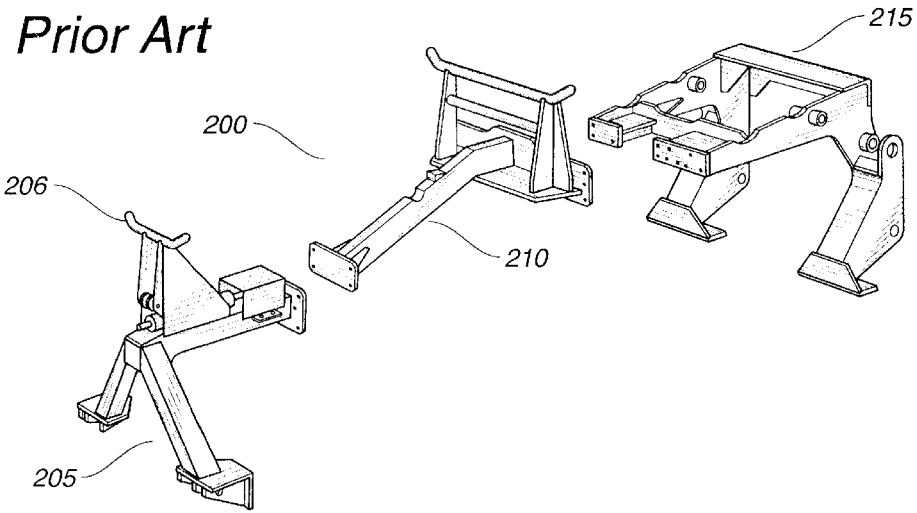
FIG. 3A Prior Art
FIGS. 3A and 3B depict separated perspective view and a top plan view, respectively, of the framework portion of the sideboom depicted in FIGS. 1A and 1B.
Figure 3B:
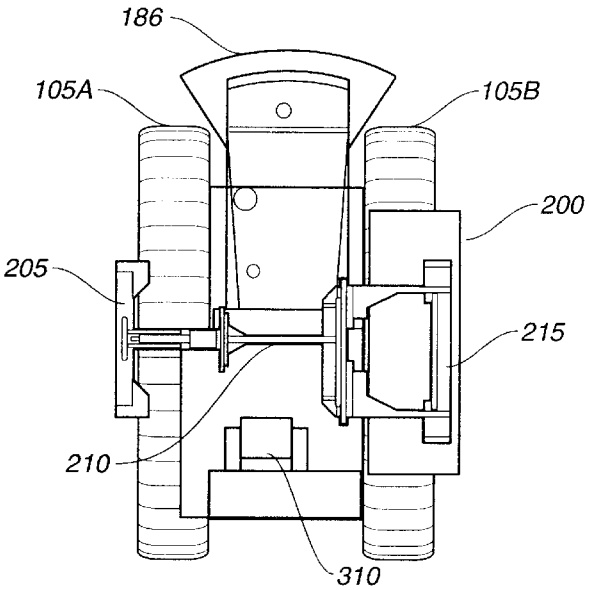
FIG. 3B Prior Art

Referring now to FIG. 3A, there is shown a simplified frontal perspective view of framework means 200 commonly used on old, discontinued, mechanically-operated, low-drive, Caterpillar sidebooms. Framework 200 is depicted as being constructed from three members which are shown separated from each other: left frame 205, center section 210, and right frame 215. In a manner well known in the art, framework 200 is mounted to the track roller frame and the main frame of old, discontinued, mechanically-operated, low-drive, Caterpillar sidebooms. In particular, left frame 205 mounts the boom 114, load line sheave 126, and boom stop 206; right frame 215 mounts counterweight assembly 150 and drawworks 110. Center section 210 interconnects left frame 205 and right frame 215. FIG. 3B shows an in situ top planar view of framework 200.

Figure 4:
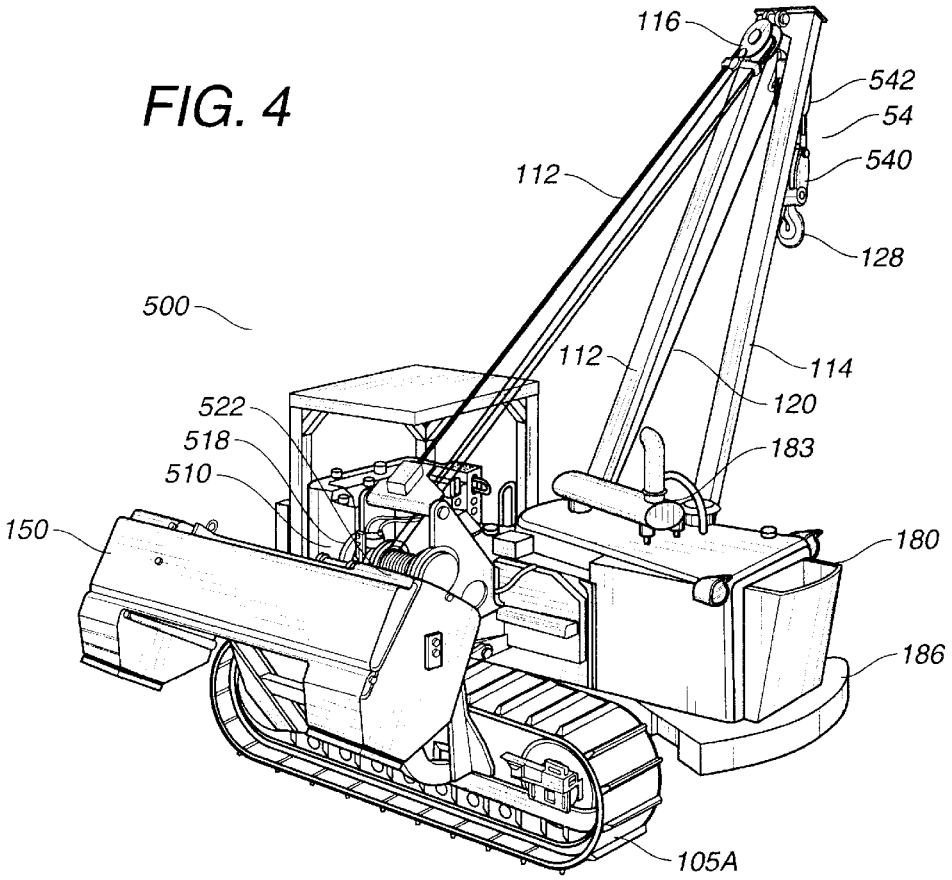
FIG. 4 depicts a frontal perspective view of the same model of Caterpillar sideboom after the replacement apparatus embodying the present invention has been installed.

Now referring to FIG. 4 there is illustrated a front perspective view of a conventional, old, discontinued low-drive mechanically-operated Caterpillar sideboom converted into a low-drive hydraulically-operated sideboom according to the teachings of the present invention. More particularly shown for such a converted, modernized sideboom 500 are drawworks means 510 which supersedes mechanical drawworks 110 (see FIGS. 1A and 1B) and control means for controlling the sideboom, as will be hereinafter described in detail. As will be appreciated by those skilled in the art, the remaining components are similar to the like-numbered components shown in the original mechanically-operated Caterpillar sideboom depicted in FIGS. 1A and 1B.

Thus, referring to the old, discontinued, mechanically-operated, low-drive, Caterpillar sideboom depicted in FIGS. 1A and 1B and to the corresponding converted low-drive hydraulically-operated sideboom taught by the present invention depicted in FIG. 4, it is readily seen that replacement drawworks 510 integrates with boom 114, boom cable means 112, load cable means 120, counterweight means 150, and, of course, track means 105A and 105B, all of which are unchanged by the retrofitting of the present invention. It will be appreciated by those skilled in the art that replacement drawworks 510 is affixed to existing framework 200 (see FIG. 3) by using the bolt holes already in place. In accordance with the present invention, replacement drawworks 510 is configured to be readily received into a plurality of preexisting bolt holes, once the discontinued mechanical drawworks 110 is removed. Of course, minor fit adjustments may be made to align one or more holes or other conventional securing means known in the art. Such adjustments are not surprising in view of the demanding pipelaying applications to which sidebooms are subjected on a routine basis, wherein predictable impact with rough terrain and the like are the order of business. The replacement assembly of the present invention exploits the suitability of the older, low-drive sidebooms for pipelaying operations under such exigent conditions by essentially augmenting the existing rigid framework with a modern hydraulic mechanism for simultaneously manipulating the boom and a typically heavy, cumbersome pipe load.

Ergo, the hydraulic replacement apparatus contemplated by the present invention is insertably received by framework means 200 and then secured thereto preferably using conventional nuts and bolts. Once this replacement has been effectuated, typically in 2 to 3 days, a low-drive mechanically-operated Caterpillar sideboom has been metamorphosed into a safe, modern low-drive hydraulically-operated sideboom heretofore unknown in the art. The auxiliary drive shaft 154 (see FIG. 1A) that was formerly interconnected with the mechanical clutch of the mechanical drawworks is now interconnected with the hydraulic pump of the replacement hydraulic drawworks. As will be hereinafter described, since the single lever control means taught by the present invention is already attached to the instant conversion package; no further interconnections are required before hydraulic sideboom operation commences.

It has been found that embodiments of the present invention enable conversion of Caterpillar model numbers 572E, 572F, 572G, 583H, 583K, 594G; and 594H—all being part of the category described as mechanically-operated low-drive pipelayers—into modern hydraulically-operated sidebooms by replacing the drawworks assembly as herein described and supported by a control assembly that controls manipulation of the boom and pipe load, while at the same time providing a great degree of safety, ease of operation, and efficiency.

Caterpillar model numbers 572E, 572F, 572G, 583H, 583K, 594G, and 594H are indicative of such mechanically-operated pipelayers, and have been superseded by a like plurality of hydraulically-operated, high-drive Caterpillar models including 561H, 578, 589, and 583R. As hereinbefore described, the hydraulic replacement apparatus contemplated by the present invention is insertably received by framework portion 200 and secured thereto. As will be appreciated by those skilled in the art, this replacement procedure typically takes a mechanic only 2 to 3 days, with minor fit adjustments being made as appropriate.

Figure 5:
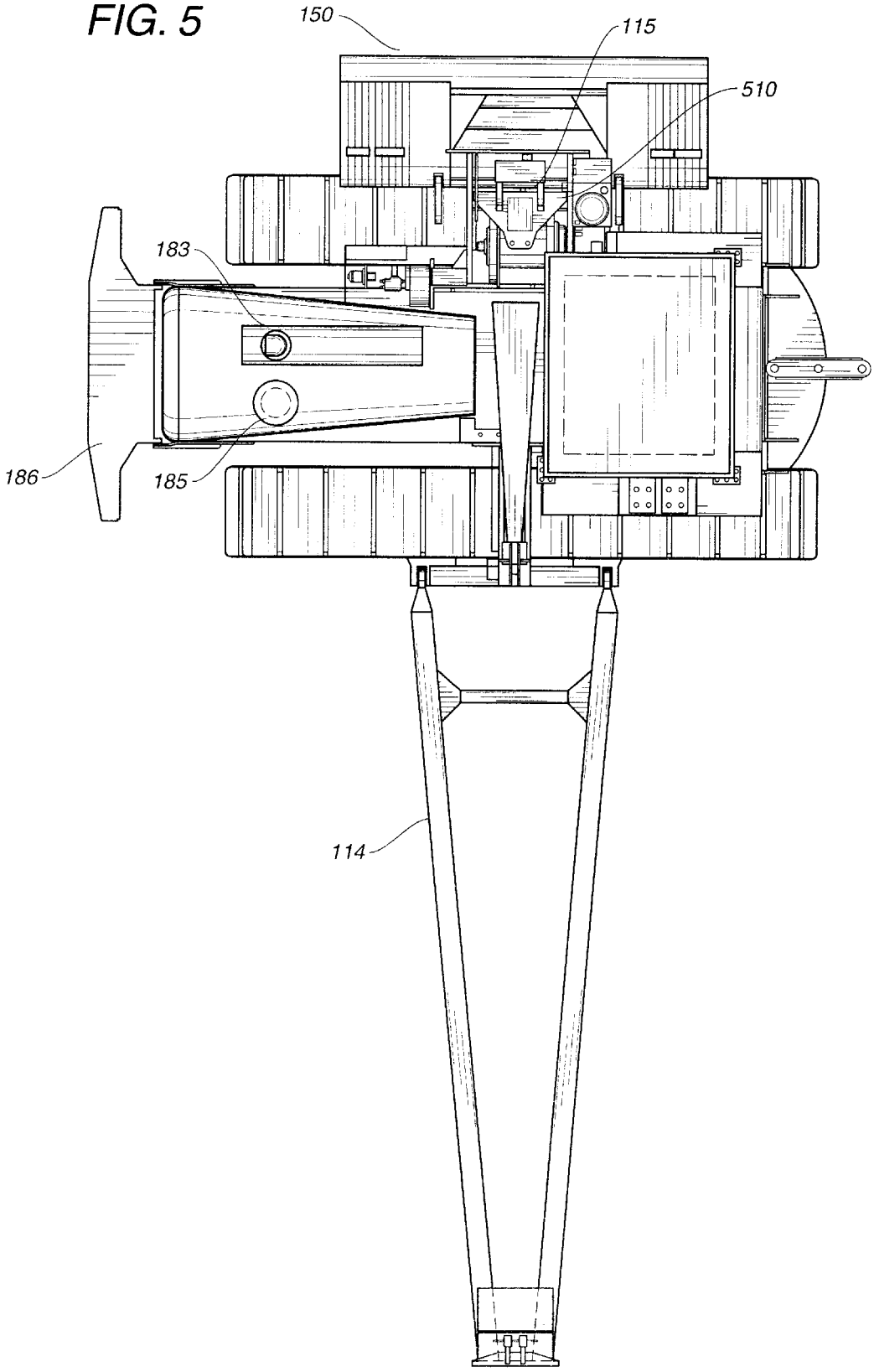
FIG. 5 depicts a top plan view of the replacement apparatus embodying the present invention depicted in FIG. 4.

Specifically referring now to FIG. 5, there is shown a top view of the replacement apparatus 510 taught by the present invention integrated with a formerly old, discontinued, mechanically-operated, low-drive, Caterpillar sidebooms. It has been converted into a hydraulically-operated machine according to the teachings described herein. Generally depicted therein are lifting boom 114, boom support means 115, bumper 186, muffler 183, engine exhaust 185, and counterweight assembly 150.

Figure 6:
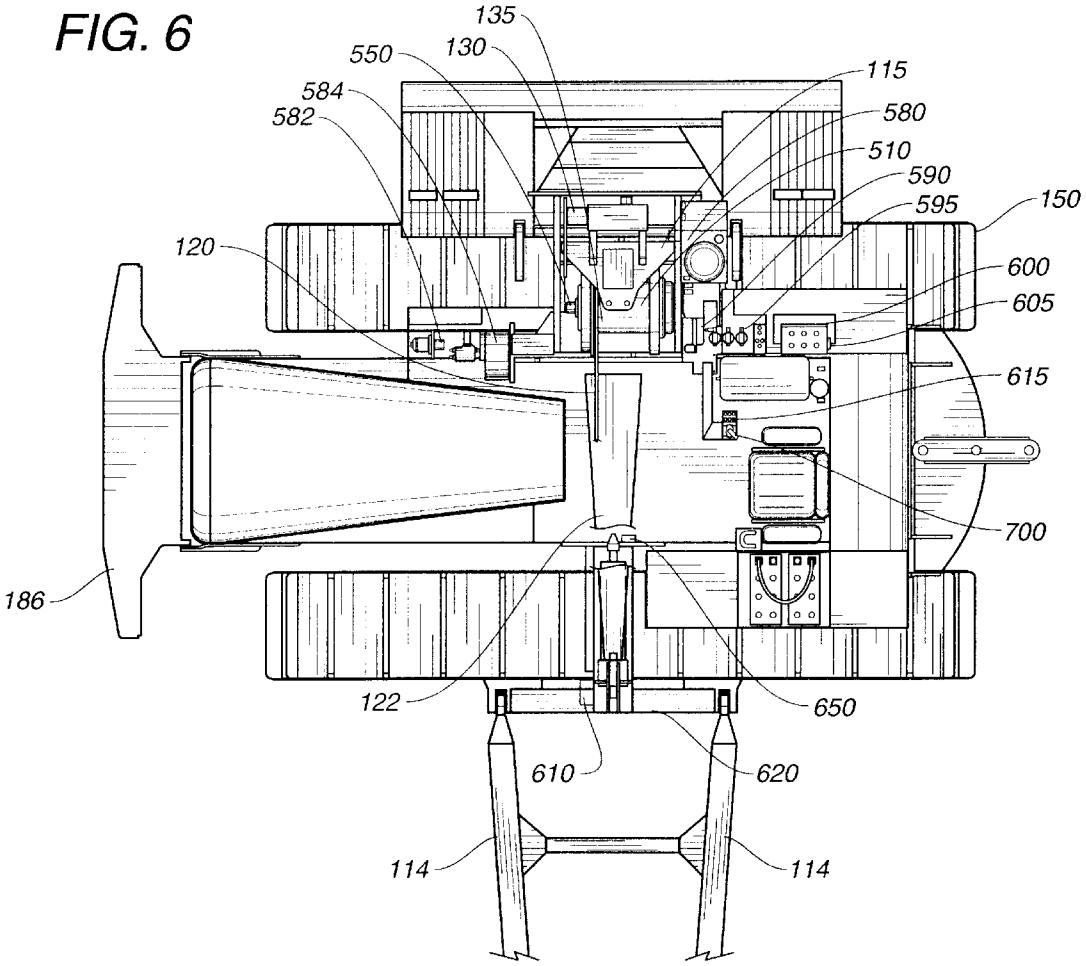
FIG. 6 depicts a detailed top plan view of the replacement apparatus depicted in FIG. 5.

FIG. 6 is another a top view of the replacement apparatus 510 taught by the present invention integrated with a formerly mechanically-operated low-drive Caterpillar sideboom, showing greater detail than the embodiment depicted in FIG. 5. Drawworks assembly 510 comprises boom winch 530, load winch 535, and conventional hydraulic system components including hydraulic oil tank 580, pump means 582, gearbox means 584, distributor valves 590, and electrovalves 595. Load cable 120 is shown contained within cable protection shield 122. The term "electrovalve" is meant to apply to a valve whose positions are actuated electrically, e.g., solenoid-operated valve. Further shown are the plurality of control assembly components which now enable low-drive Caterpillar sideboom movements to be manipulated and controlled in a manner heretofore unknown in the art.

In particular, also shown are anti-two-block 550 and anti-tipping and anti-two block electric panel 600, horn in electric panel 605 disposed near operator's seat 310, horn 610 disposed on boom support 620, lift system indicator and control panel 615, and single lever control means 700 affording simultaneous single hand control of boom and load as will be hereinafter described.

Another aspect of the present invention is an anti-two-blocking feature which prevents contact between upper load block 142 and hook block 116. As is clear to those skilled in the art, two-blocking occurs when power is applied to the load in spite of there being close proximity between the upper load block and the boom block. Not only can block-to-block damage be caused, but also there can be damage to the load and, of course, a safety hazard arises wherein the load may be inadvertently released from the hook. Also shown is the electronic switch 650 that prevents boom 114 from reaching a vertical position.

Figure 7:
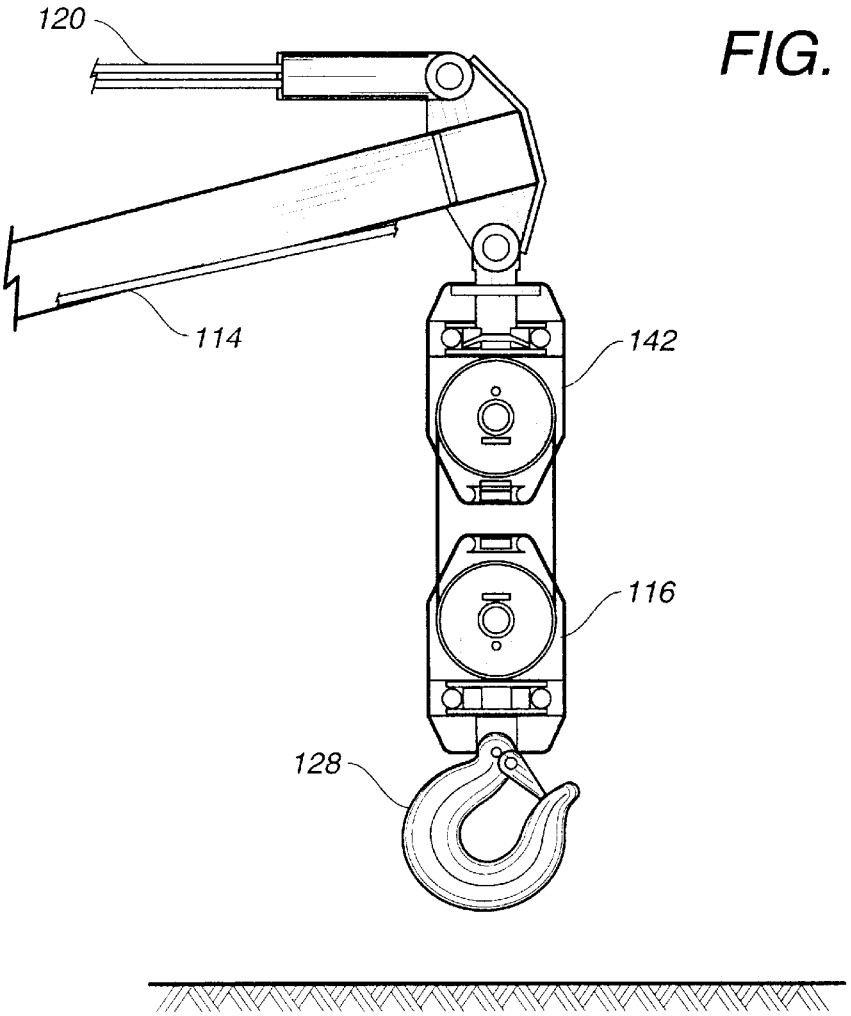
FIG. 7 depicts an enlarged frontal view of the anti two-block apparatus embodying the present invention.

Referring now to FIG. 7, there is shown an enlarged frontal view of the anti two-block apparatus corresponding to anti two-block control system 550 depicted in FIG. 6. Specifically, there is shown hook block 116 coupled to hook 128 and to load block 142. Also shown are boom 114 and boom cable 120. Prior to lifting loads, a sideboom operator purposely positions the load block 142 and the hook block 116 in a proximal relationship. He then presses a button or the like on the control panel which establishes the relative position of the load and the boom winches to each other. This is preferably accomplished under the present invention using timing gears, coupled to revolution counters as will be hereinafter described, which are preset when the designated button in the control panel is pressed. Then, when the timing gears come into the preset relationship, an electrical signal is sent to the electronic control panel and further lifting of the load is immediately prevented.

Figure 8:
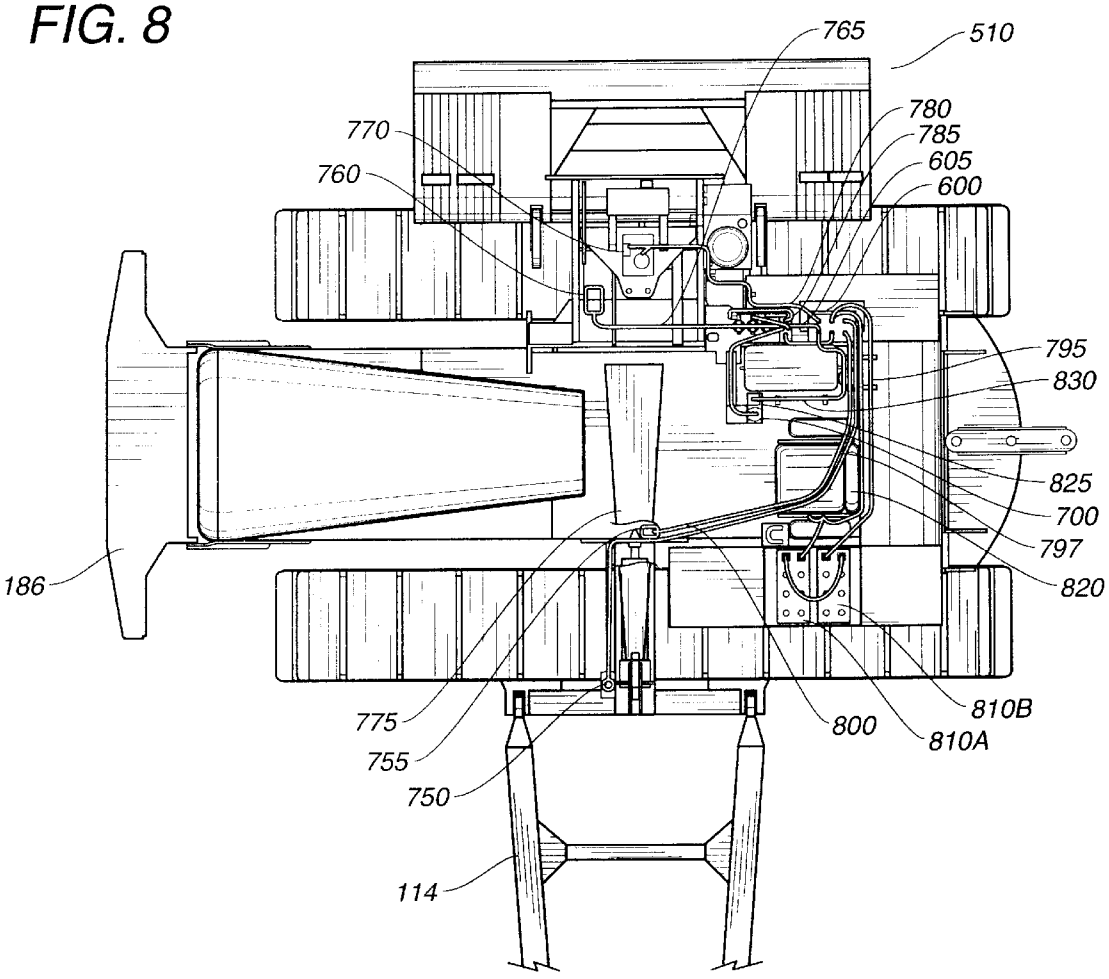
FIG. 8 depicts a simplified top view of the electrical wiring interconnecting the apparatus depicted in FIG. 6.

FIG. 8 shows the positioning of electric cables corresponding to the apparatus depicted in FIG. 6. Now referring to FIGS. 6 and 8, there is seen boom angle sensor and load sensor 770 electrically interconnected with load cell 775 through cable means 780. Anti-two block revolution counter 760 is coupled to a plurality of electrovalves 595 through cable 765. Single lever control means 700 is electrically coupled to plurality of electrovalves 595 and to junction electric box 785 through cable 805 as will be hereinafter described. As clearly seen in FIG. 8, each of the following are interconnected with electronic control panel 600: vertical boom kick-out cable means 800, angle sensor cable means 780 (coupled to angle sensor 770), horn alarm cable means 820 (coupling horn means 605 in electric panel and side horn means 610), single lever control cable means 805 (coupling single lever control means 700 and electrovalves 595), and battery cables 795 (interconnecting battery 810A) and 797 (interconnecting battery 810B).

Figure 9:
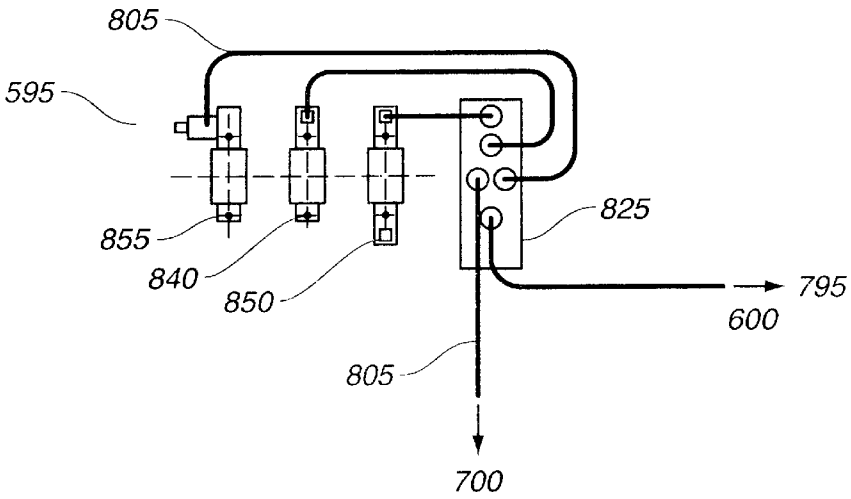
FIG. 9 depicts an enlarged top view of the plurality of electrovalves depicted in FIG. 8.

FIG. 9 depicts an enlarged top view of plurality of electrovalves 595 depicted in FIG. 8. In particular, shown are kick-out hook electrovalve 835, kick-out boom electrovalve 840, and main electrovalve 850, and implicated plurality of cable means. As will be appreciated by those skilled in the art, when any of this plurality of valve means is electrically triggered, an immediate response is activated in embodiments of the present invention. For example, when solenoid switch 835 is triggered, it actuates electrovalve 835, thereby releasing hydraulic pressure on load winch 135 and free fall occurs. Similarly, when kick-out boom electrovalve 840 is triggered, hydraulic pressure on boom winch 130 is released and further inward boom movement is prevented. As is known in the art, a suitable sensor is coupled to such a kick-out valve to communicate when the boom is raised to a vertical position. Referring to FIGS. 8 and 9, it is shown that there is electrical communication between single control lever 700 and boom kick-out valve 840 to indicate the position of boom means 114 relative to its being full-up vertical. As is known in the art the boom position may be ascertained via spring-loaded sensing means disposed along the boom 114 wherein raising the boom to a vertical position causes the spring's bias to be overcome and, in turn, to issue an electrical signal that triggers boom kick-out valve 840.

It should be evident to those skilled in the art that the present invention delivers to the pipelaying sideboom art improvements over the techniques that have been used in the crane art. For instance, the Moore-Olsen anti-two-block apparatus disclosed in U.S. Pat. No. 4,523,686 is essentially a mechanical system that requires seven complexly-configured gears that are driven by air pressure. It should be clear that such an anti-two-block system is inapplicable in a sideboom contemplated by the present invention having only limited physical size to accommodate operational controls and the like. Of course, from a two-block logistics standpoint, in a crane, the wire rope passes over the top of the boom, then reaved onto a sheave that is integrated with the boom's remote tip; in a sideboom contemplated by the present invention, the wire rope, contrariwise, passes through a sheave block that is suspended from the tip of the boom. Furthermore, while a crane may be constructed with two hoist drums and two lifting hooks—a main hook and an auxiliary hook—a sideboom obviously is inherently constructed with only one lifting hook. Unlike the complexity of Moore's system, the present invention uses no gears but only a microprocessor device to determine the relative position of the two blocks.

Similarly, the free fall aspect of the present invention improves the pipelaying art, wherein a sideboom operator may rapidly release his pipe load on his load line and thereby manage to sustain his sideboom remaining in an upright position. As is well known in the pipelaying art, free fall is an emergency procedure that should preferably be invoked immediately when at least one of several sideboom operators fails to coordinate the holding a long section or string of pipe. If a technique is not available for immediately releasing the pipe load under these circumstances, then sidebooms will be pulled or tipped over. In U.S. Pat. Nos. 3,265,218 and 3,938,669, Stefanutti and Vinton, respectively, describe systems that uses hydraulic cylinders to cause a boom to be raised or lowered and to be extended telescopically, and to cause a load to be similarly raised or lowered. But, as will be evident to those skilled in the pipelaying art, Vinton does not contemplate the use of winches to control either the boom or the load; the only cable line implicated is disposed at the end of the load hydraulic cylinder which passes over a pulley at the top of the boom and terminates at the load hooks While also not specifically invoking a free fall technique, in U.S. Pat. No. 3,722,707, Hedeen provides a dump valve that automatically depressurizes the hydraulic system. Invoking the Hedeen dump valve causes the sideboom system to lock-up or freeze, whereby no further raising of the boom and hoist line hooks is permitted. Thus, while obviously preventing hazardous pipelaying conditions attributable to further raising the pipe load, this dumping procedure fails to provide a free fall aspect contemplated by the present invention. Hence, the present invention enables a free fall feature heretofore unknown in the pipelaying art.

Figure 10:
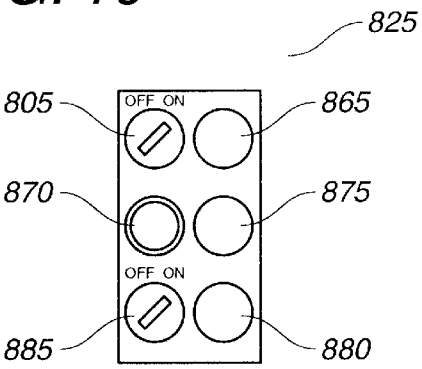
FIG. 10 depicts an enlarged view of the operator's electronic indicator and control panel.

FIG. 10 depicts an enlarged view of electronic indicator and control panel 825 disposed proximal to joystick control means 700 and depicted in FIG. 8. Shown therein are plurality of indicators which communicate the condition of sideboom operation. Starting at the upper left, the master switch 860 is positioned either in an on or off position by key-activation. A power "on" condition is illustrated when indicator 865 is illuminated by a green light. If electric fault indicator 870 is illuminated by a white light, that indicates that an electrical fault has occurred. Indicators 875 and 880 are used to signal an anti-tipping situation. First, indicator 875 is illuminated by a yellow light when an overload situation is imminent. Next, indicator 880 is illuminated by a red light at the instant that an overload occurs. It should be evident to those skilled in the art that this control panel is situated adjacent the operator's seat so that the operator may readily see the status of the indicators, and so that the pipelayer system may be immediately shut off if necessary. An anti-tipping system by-pass switch means 885 is either in an on or off position; this switch is typically controlled using a key means, a spring-loaded switch, or the like.

Converted sidebooms contemplated by the present invention can include a computerized anti-tipping feature that measures the angle of the boom and the load thereon. A microprocessor calculates the sideboom's oblique tipping moment and compares this moment against a predetermined maximum value. It is an advantage of the present invention that unstable sideboom operation due to tipping is precluded because this maximum stable tipping moment is not exceeded. Referring to FIGS. 8–10, as will be evident to those skilled in the art, when this tipping moment limit is being approached, the microprocessor informs the operator by illuminating indicator 875, preferably with a yellow warning light. If, and when the moment stability threshold is actually reached, the microprocessor further informs the operator by illuminating indicator 880, preferably with a red warning light and all the lifting action ceases. Simultaneously, to signal an incipient dangerous condition, the present invention also sounds an alarm via a plurality of horn means electrically interconnected with electronic control panel 600. As will be evident to practitioners in the art, upon this alarm condition occurring, an operator has no choice but to return the sideboom to a stable condition by reducing the oblique tipping moment: the load must be lowered and/or the load must be moved closer to the sideboom, or both.

It will be appreciated that this anti-tipping feature, in conjunction with the herein before described concomitant hook and boom kick-out features, provides safe and convenient operation of old, discontinued, mechanically-operated, low-drive, Caterpillar sidebooms. This combination was heretofore unknown in the art.

FIGS. 11A–C depict a schematic of the anti-tipping feature contemplated by the present invention. Represented at the top of each of FIGS. 11A–C are captions which indicate the portion of the electronic circuitry being described in the schematic. Referring to FIG. 11A, shown are the components comprising the general system, the control system, and the electronic card load and angle. General system components shown include pair of 23 amp four poles panel sockets AX4 and CX4; 5×50 2 amp fuse F1; pair of 19 poles panel socket AX3 and BX3; white light magnetotermic device (in control panel) H1; and 10 amp magnetotermic device Q1. Components shown comprising the control system are pair of 19 poles panel socket CX3 and DX3; system control selector (in control panel) S1; and system control contactor K1. For the right portion of FIG. 11A, corresponding to electronic card load and angle, the components shown are load and angle electronic card SCH and related control panel components safety temporary key by-pass selector S2 and system control selector S1; and plurality of 7 poles panel sockets AX6, BX6, CX6, EX6, FX6, and GX6, and 3 amp fuse F6.

Referring now to FIG. 11B, shown are the components comprising the signalling feature of the present invention including pre-alarm, normal operation, and alarm; by-pass feature including temporary and safety; kick-out feature including boom and load (labeled as block); impulse emitter; and boom electrovalve. Signaling pre-alarm system components shown include 19 poles panel socket GX3; pre-alarm orange or yellow indicator light H2; and 19 poles panel socket KX3. Signaling normal operation components shown are power green light indicator (control panel) H3 and 19 poles panel socket LX3. Signaling alarm components include alarm red light indicator (control panel) H4 and 19 poles panel socket X3. By-pass temporary feature components include 2 amp 5×20 fuse F2 and 19 poles panel socket EX3. By-pass safety feature components include safety temporary key by-pass selector (control panel) S2 and 19 poles panel sockets FX3, JX3, and HX3. Kick-out boom and load feature components include 13 amp 4 poles panel socket AX5; 10 poles panel socket AX1; kick-out boom S3; hook block winch encoder S4; 13 amp 4 poles panel socket CX5; 10 poles panel sockets BX1 and CX1; boom contactor K2; and block contactor K5. Impulse emitter feature components shown include boom contactor K2; block contactor K5; and impulse emitter K3. Boom electrovalve feature components shown include boom contactor K2; 3 amp 5×20 fuse F3; 14 poles panel sockets DX2 and AX2; and boom electrovalve EV1.

Referring now to FIG. 11C, shown are the components comprising the time alarm feature of the present invention; block electrovalve; joystick and electrovalve movements; impulse emitter; time diagnosis; alarm and diagnosis signalling; and pre-alarm signal. Time alarm system components shown include boom contactor K2; excitation delayed alarm timer K4; and block contactor K5. Block electrovalve components shown include block contactor K5; 3 amp 5×20 fuse F4; 14 poles panel socket CX2; and block electrovalve EV2. Single control lever/joystick feature components shown include hydraulic joystick switch S5; 14 panel sockets EX2 and FX2; and joystick movement contactor K6. Electrovalve movements feature components shown include joystick movement contactor K6; 3 amp 5×20 fuse F5; 14 poles panel socket BX2; and joystick movement electrovalve EV3. Impulse emitter components shown include joystick movement contactor K6; and impulse emitter K7. Time diagnosis feature components shown include impulse emitters K7 and K3; and disexcitation delayed diagnosis timer K8. Alarm and diagnosis signalling components shown include disexcitation delayed diagnosis timer K8; excitation delayed alarm timer K4; alarm and diagnosis horn H5; and 19 poles panel socket MX3. Pre-alarm signal components shown include KP; AX7 and CX7; and alarm and diagnosis horn H6.

It will be readily understood by those skilled in the art that the anti-tipping feature of the present invention constitutes a significant contribution to the pipelaying sideboom art. This is particularly evident in view of the metamorphosis that occurs using the instant replacement assembly for converting a mechanically-operated low-drive sideboom into a hydraulically-operated low-drive sideboom. Although only remotely relevant to the pipelaying art, there have been anti-tipping techniques taught in the crane art that provide insight into the significance of the present invention.

As an example, Couture et al. teach a safety control system to prevent a crane from lifting more than its capacity in U.S. Pat. No. 4,236,864. More particularly, Couture seeks to control the safe limits of elevating and/or telescoping the boom, and also to control the safe swinging limits right and left of the boom. Of course, limiting the swinging moment of a boom and limiting the elevation of boom sections of a crane is much simpler than preventing anti-tipping of a pipelaying sideboom which, unlike the boom of a crane, is non-telescoping. Furthermore, the inapplicability of the teachings of Couture to anti-tipping is stated by Couture and his co-inventors wherein it is explicitly stated that capsizing is not a concern. As hereinbefore described, it will be appreciated by those skilled in the art that constantly monitoring the angle of the boom (in a sideboom contemplated by the present invention) and the weight of the pipe load on the load hook to achieve non-tipping pipelaying operation is far more sophisticated than simply limiting the swing of the boom of a crane. As is well known by those skilled in the art, the boom of a sideboom contemplated by the present invention does not telescope and there are no sidebooms that swing or rotate upon a center pin as is commonplace for a crane.

Specifically referring now to FIG. 12, there is shown the simplified control means 500 taught by the present invention. As will become clear to those skilled in the art, joystick means 700 replaces the conventional 6 controls that are necessary to control all of the movements of boom line 112 and load line 120. Also shown are the steering clutches 285A and 285B, foot-actuated band brakes 280A and 280B, throttle 760, and tractor travel transmission selector 701, all of which are unchanged after the conversion.

Now referring to FIG. 13, there is shown the joystick control means 700 that controls all of the lifting functions of the sideboom. As depicted in position A, joystick 700 is pivoted into a left horizontal direction to move the boom 114 affixed to boom line 112 downwards. Contrariwise, as depicted in position B, joystick 700 is pivoted into a right horizontal direction to move the boom 114 affixed to boom line 112 upwards. Similarly, as depicted in position C, joystick 700 is pivoted inwardly toward the operator to move hook means 128 affixed to load line 120 upwards. Contrariwise, as depicted in position D, joystick 700 is pivoted outwardly from the operator to move hook means 128 affixed to load line 120 downwards. Similarly, as depicted in position E, joystick 700 is pivoted into a diagonal direction to the right and outwardly away from the operator to both move boom 114 upwards and hook 128 downwards (approximately a 2 o'clock position). Contrariwise, as depicted in position F, joystick 700 is pivoted into a diagonal direction to the left and inwardly towards the operator to both move boom 114 downwards and hook 128 upwards (approximately an 8 o'clock position). As depicted in position G, joystick 700 is pivoted into a diagonal direction to the left and outwardly away from the operator to both move boom 114 downwards and hook 128 downwards (approximately a 10 o'clock position). Contrariwise, as depicted in position H, joystick 700 is pivoted into a diagonal direction to the right and inwardly towards the operator to both move boom 114 upwards and hook 128 upwards (approximately a 4 o'clock position).

Thus, as will be clear to those skilled in the art, if an operator must make a sudden change in the disposition of a sideboom, the single lever joystick feature of the present invention enables such change to be effectuated immediately: the operator merely manipulates this joystick means in the proper direction and the change in boom and/or hoist disposition is immediate. Heretofore, as is readily understood by those skilled in the art, effecting "sudden" changes using older, discontinued, mechanically-operated, low-drive, Caterpillar sidebooms, unfortunately, requires a series of time-consuming operator-instigated manipulations including shifting gears, adjusting direction of transmission, applying hand-brakes, manipulating clutches, etc. The present invention transcends the capabilities taught by Villa in U.S. Pat. No. 4,566,599, wherein a plurality of crane control handles, e.g., plurality of joysticks, is used to remotely operate a crane having a swingable upper drawworks disposed on an offshore platform. Even though any crane application is distinct from a pipelaying sideboom application because a sideboom does not swing and a crane doesn't suffer from the extreme space limitations for implementing and containing operational and control infrastructure as does a sideboom—especially an old, discontinued mechanical sideboom contemplated by the present invention. In addition, unlike Villa that discloses remote control operation and clutch actuation, the present invention requires no clutches for actuation and does not address remote control. Thus, it is an advantage and feature of the present invention that an ability to instantaneously and easily effect all sideboom movements is achieved by means heretofore unknown in the art.

It should be understood, however, that since the operation of the boom and load lines have been rendered profoundly easy and convenient by the present invention, requiring only one hand for all movements thereof, it has been found to be advantageous for safety reasons to include a locking means which must be activated before joystick means 700 is, in turn, activated. Thus, in the preferred embodiment of the present invention, a thumb release actuator button 710 protrudes atop joystick 700 and must be both depressed and held down in this depressed position in order for the joystick operation described herein to be effectuated. That is, if thumb release actuator button means 710 is not held in a depressed position, an electronic micro switch renders joystick means 700 unable to effect any movement of either boom drum 130 or load drum 135.

It will be observed by those skilled in the art that both conventional hand-operated boom and load winch brake levers 260 and 265 (FIG. 2), have also been eliminated. According to the preferred embodiment of the present invention, braking is automatically actuated when joystick means 700 is in its default vertical position. The operator merely releases the joystick and all braking means are automatically actuated. Of course, as will be evident to those skilled in the art, foot and hand controls required to propel the entire machine via its crawler undercarriage forward and backward have not been affected by the present invention.

It should be evident to those skilled in the art that the present invention eliminates the Butterfield planetary gearing system by replacing it with a gearless hydraulic system. It should also be clear that the present invention does not provide an add-on, such as taught by Nichols or Solomon in U.S. Pat. No. 6,392,936, to a tractor. Indeed, the present invention provides a replacement assembly for converting such a sideboom into a hydraulically-operated sideboom.

Furthermore, the present invention teaches a replacement assembly that is intended to function seamlessly with any style or design of a boom of a sideboom. Whereas Wade teaches adding a foldable boom to an tractor. The present invention is thus compatible with any boom disposed upon a sideboom tractor.

The present invention uses winches and cables to control the boom and the load, which is distinct from the Vinton system which teaches use of hydraulic cylinders to control the boom and the load.

Other variations and modifications will, of course, become apparent from a consideration of the structures and techniques herein before described and depicted. Accordingly, it should be clearly understood that the present invention is not intended to be limited by the particular features and structures herein before described and depicted in the accompanying drawings, but that the present invention is to be measured by the scope of the appended claims herein.

What is claimed is:

1. In a mechanically-driven, low-drive sideboom for lifting and lowering a heavy load, having a rigid framework, a drive shaft, a boom pivotally attached at one end thereof to said rigid framework, a mechanically-driven drawworks including a boom line means for controlling the position of said boom relative to said framework and a load line means for controlling the position of said load relative to said framework, said load line means having a top load block and a hook block combination attached at the top remote end of said boom disposed oppositely of said one end thereof; a replacement assembly for converting said mechanically-driven, low-drive sideboom into a hydraulically-driven, low-drive sideboom comprising;

a hydraulically driven drawworks assembly having:

a boom winch means configured for receiving said boom line means;

a load winch means configured for receiving said load line means;

a hydraulic pump coupled to said drive shaft;

anti-two block means electrically coupled to said load winch means for preventing contact between said hook block and said top load block;

free-fall means coupled to said load winch means for releasing hydraulic pressure on said load winch means; and anti-tipping means coupled to said boom line means for preventing tipping of said converted hydraulically-driven, low-drive sideboom, with said hydraulically-driven drawworks assembly configured to be fixedly received by said rigid framework and configured to operate said boom line means and said load line means with a single lever joystick control means coupled to said boom line means and to said load line means for maneuvering the relative position of either of said boom or said load separately and for simultaneously maneuvering the relative position of both said boom and said load.

2. The apparatus recited in claim 1, wherein said single lever joystick control means includes actuator means affixed atop thereof for activating said single lever joystick control means by sustaining pressure on said actuator means.

3. The apparatus recited in claim 1, wherein said anti-two block means is configured with timing gear means coupled to revolution counter means for calibrating the close proximity of said top load block to said hook block for preventing contact between said top load block and said hook block.

4. The apparatus recite claim 1, wherein said freefall means, when manually activated, releases the hydraulic pressure to said load winch means, thereby causing said hook block, with said load attached thereto, to rapidly fall to the ground.

5. The apparatus in claim 1, wherein said anti-tipping means includes load sensor means and boom angle sensor means coupled to said boom line means for simultaneously monitoring said load and said boom for automatically preventing tipping of said converted hydraulically-driven, low-drive sideboom based upon a predetermined maximum value of said converted hydraulically-driven sideboom's tipping moment.

6. The apparatus recited in claim 5, wherein said anti-tipping means includes microprocessor means electrically coupled thereto for signaling that a tipping condition is imminent.

7. In a mechanically-driven, low-drive sideboom for lifting and lowering a heavy load, having a rigid framework, a drive shaft, a boom pivotally attached at one end thereof to said rigid framework, a mechanically-driven drawworks including a boom line means for controlling the position of said boom relative to said framework and a load line means for controlling the position of said load relative to said framework, said load line means having a top load block and a hook block combination attached at the top remote end of said boom disposed oppositely of said one end thereof; a replacement assembly for converting said mechanically-driven, low-drive sideboom into a hydraulically-driven, low-drive sideboom comprising:

a hydraulically-driven drawworks assembly having:

a boom winch means configured for receiving said boom line means;

a load winch means configured for receiving said load line means;:

a hydraulic pump coupled to said drive shaft; with said hydraulically-driven drawworks assembly configured to be fixedly received by said rigid framework and configured to operate said boom line means and said load line means with hydraulic control lever means coupled to said boom line means and to said load line means for maneuvering the relative position of either of said boom or said load separately and for simultaneously maneuvering the relative position of both said boom and said load.

8. The apparatus recited in claim 7, wherein said hydraulic control means comprises a single lever joystick control.

9. The apparatus recited in claim 7, wherein said single lever joystick control means includes thumb actuator means affixed atop thereof for activating said single lever joystick control means by sustaining pressure on said thumb actuator means.

10. The apparatus recited in claim 7, wherein said hydraulically-driven drawworks assembly includes anti-two block means electrically coupled to said load winch means for preventing contact between said hook block and said top load block and is configured with timing gear means coupled to revolution counter means for calibrating the close proximity of said hook block to said top load block.

11. The apparatus recited in claim 7, wherein said hydraulically-driven drawworks assembly includes free fall means, when manually activated, releases the hydraulic pressure to said load winch means, thereby causing said hook block, with said load attached thereto, to rapidly fall to the ground.

12. The apparatus recited in claim 7, wherein said hydraulically-driven drawworks assembly includes anti-tipping means comprising a load sensor means and boom angle sensor means coupled to said boom line means for simultaneously monitoring said load and said boom angle for automatically preventing tipping of said converted hydraulically-driven, low-drive sideboom, based upon a predetermined maximum value of said converted hydraulically-driven, low-drive sideboom's tipping moment.

13. The apparatus in claim 12, wherein said anti-tipping means includes microprocessor means electronically coupled thereto for signalling that a tipping condition is imminent.

* * * * *